United States Patent [19]

Decker

[11] Patent Number: 4,621,988

[45] Date of Patent: Nov. 11, 1986

[54] LIQUID INTENSIFIER UNIT

[75] Inventor: Robert W. Decker, Stewartsville, N.J.

[73] Assignee: Ingersoll-Rand Company, Woodcliff Lake, N.J.

[21] Appl. No.: 776,463

[22] Filed: Sep. 16, 1985

[51] Int. Cl.[4] ..... F04B 35/02

[52] U.S. Cl. ..... 417/342; 417/347; 417/533

[58] Field of Search ..... 417/339, 342, 347, 533

[56] References Cited

U.S. PATENT DOCUMENTS

| | | | |
|---|---|---|---|
| 847,394 | 3/1907 | Beck et al. | 417/533 X |
| 1,295,511 | 2/1919 | Jernberg | 417/533 |
| 3,234,882 | 2/1966 | Douglas et al. | 417/342 X |
| 3,295,451 | 1/1967 | Smith | 417/347 X |
| 3,481,587 | 12/1969 | Ruhnau | 417/342 X |
| 4,500,267 | 2/1985 | Birdwell | 417/342 X |

FOREIGN PATENT DOCUMENTS

| | | | |
|---|---|---|---|
| 1470956 | 4/1977 | United Kingdom | 417/339 |
| 1599411 | 9/1981 | United Kingdom | 417/347 |

*Primary Examiner*—Leonard E. Smith
*Attorney, Agent, or Firm*—B. J. Murphy

[57] ABSTRACT

The unit comprises three liquid intensifiers, coupled together in juxtaposition, and fixed between a pair of plates. A support plate at the one end of the intensifiers mounts a rotary valve which, sequentially, supplies operative, low-pressure fluid to the intensifiers. A base plate at the other end of the intensifiers admits liquid into each thereof, for pressure intensification of the liquid by the intensifiers, and provides a common outlet port for the pressurized liquid.

14 Claims, 18 Drawing Figures

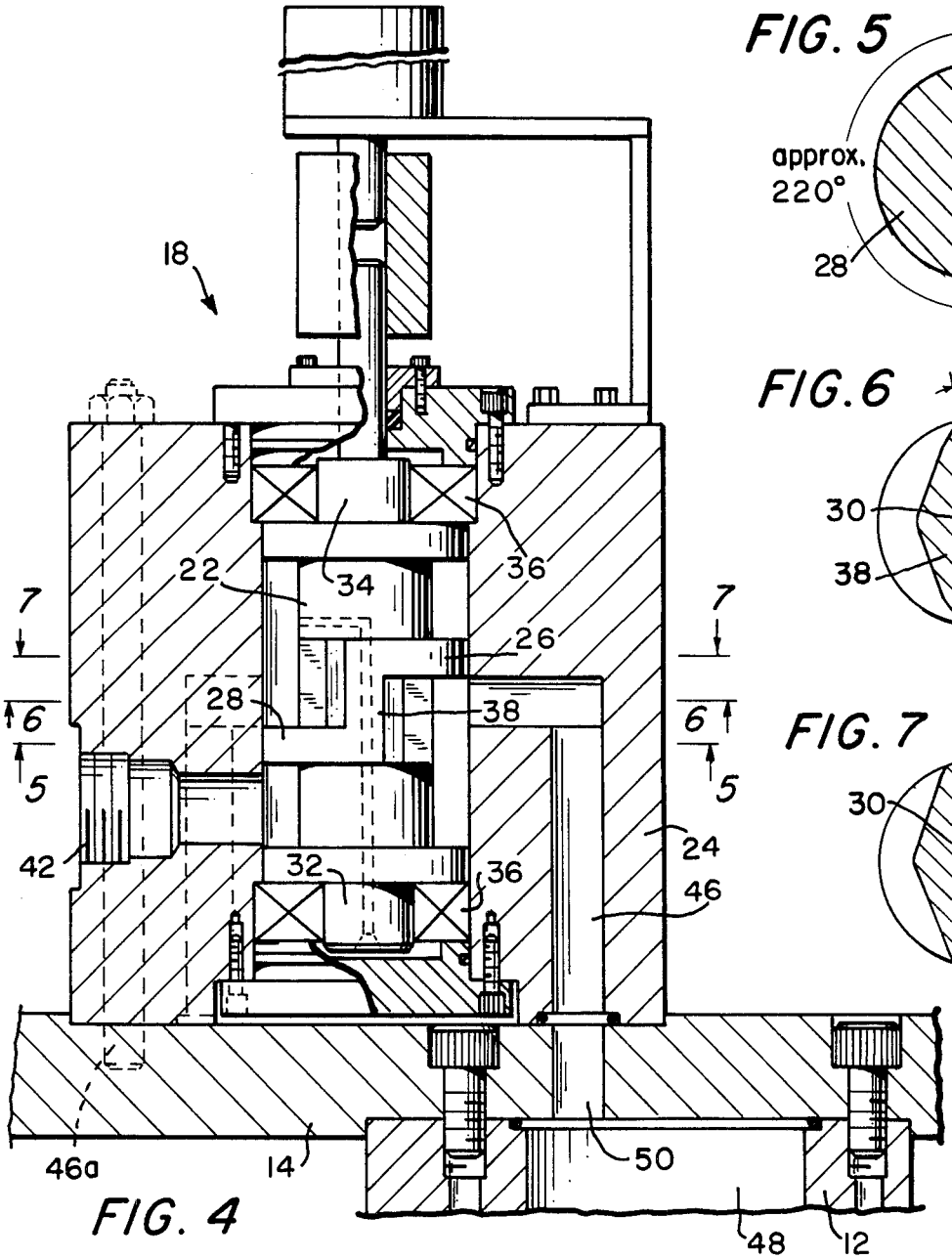
FIG. 4
FIG. 5
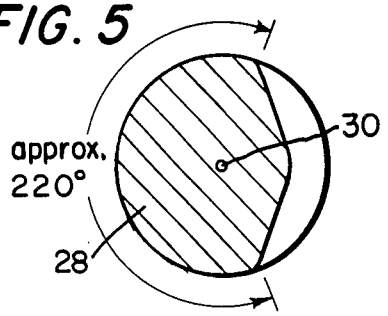
FIG. 6
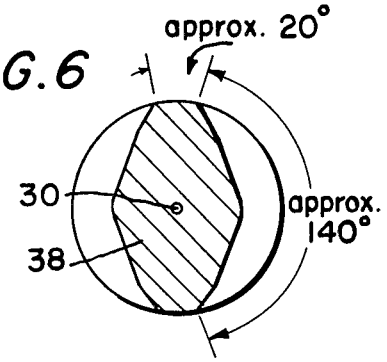
FIG. 7
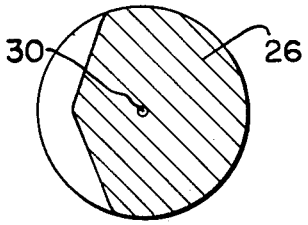
FIG. 8
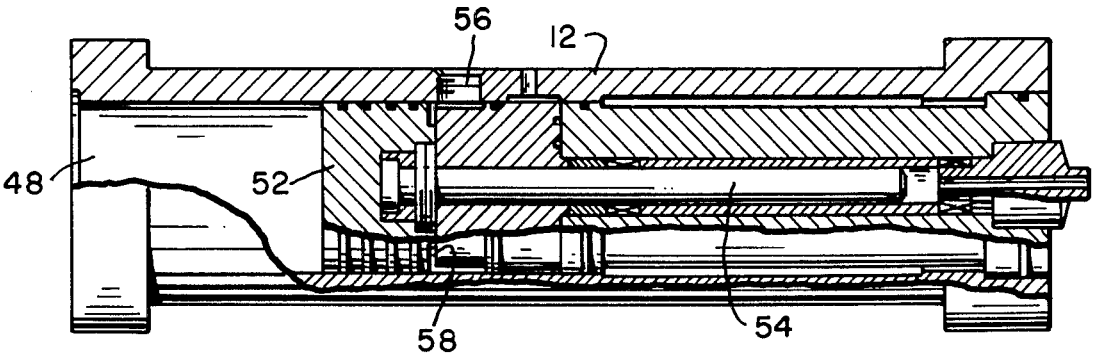

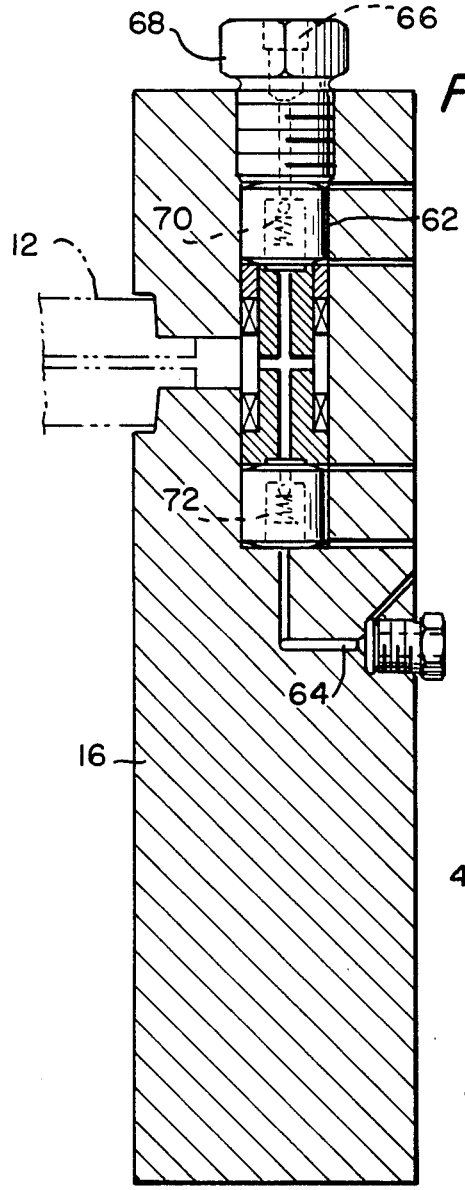
FIG. 10
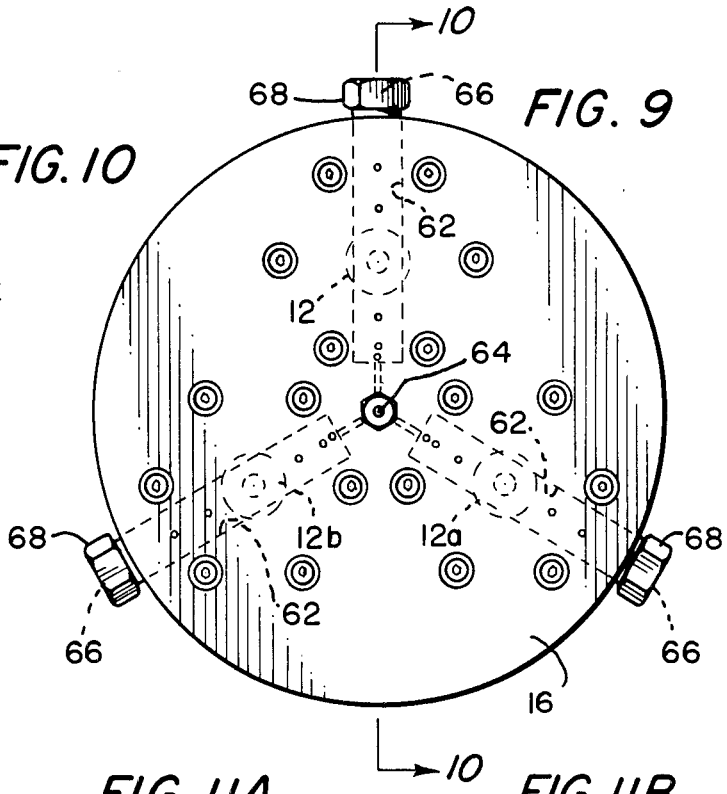
FIG. 9
FIG. 11A
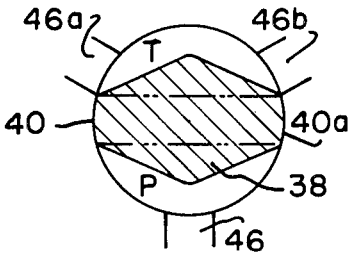
FIG. 11B
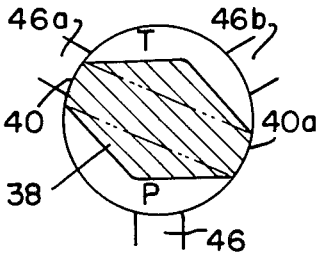
FIG. 11C
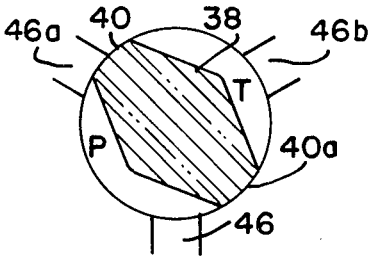
FIG. 11D
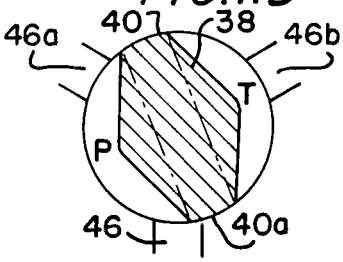
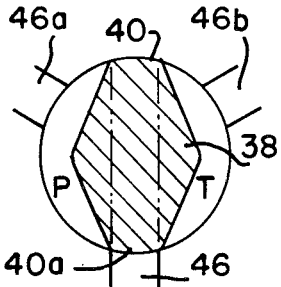
FIG. 11E
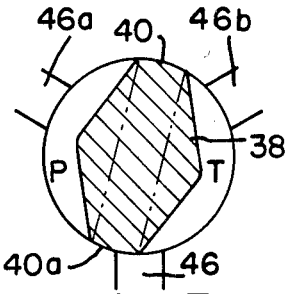
FIG. 11F
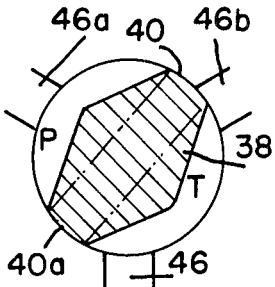
FIG. 11G
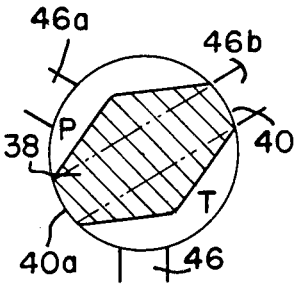
FIG. 11H

LIQUID INTENSIFIER UNIT

This invention pertains to liquid pumps, liquid intensifiers, and the like, and in particular to a liquid intensifier unit especially adapted for use in water jet cutting systems.

High pressure pumps or intensifiers employed in operations such as water jet cutting, manifest pulsations. As a consequence thereof, there are formed irregularities or undulations in the jet-cut path due to such pulsations. To minimize this, it has been proposed that a plurality of intensifiers should be employed in a packaged unit, the intensifiers thereof being cooperatively coupled together by appropriate piping, conduits and valving to effect sequential and repetitive operation of the so-coupled intensifiers. However, such piping, conduitry and valving arrangements as are commonly employed in such manifolding assemblies of very high pressure components would introduce other technical problems at least as severe as those presented by the pulsations sought to be overcome.

It is an object of this invention, then, to set forth a novel liquid intensifier unit which minimizes the aforesaid pulsations, and which does not present the piping, conduit and valving difficulties cited.

It is an especially an object of this invention to set forth a liquid intensifier unit comprising a plurality of separate liquid intensifiers; and means fastening said intensifiers together in juxtaposition; wherein each of said intensifiers has one, common means for both admitting thereinto, and discharging therefrom, respectively, an operating, low-pressure fluid; each of said intensifiers further has one, common means for both admitting thereinto, and discharging therefrom, respectively, a subject liquid for pressure intensification of such liquid by such each intensifier; each of said intensifiers also has a given, variable-volume chamber formed therewithin for receiving therewithin, and expelling therefrom, an operating liquid; and further including means effecting an open, fluid communication of each of said given, variable-volume chambers with each of the others thereof for conducting operating liquid, expelled from a given chamber of one of said intensifiers, to said given chamber of another of said intensifiers; and valving means, coupled to said intensifiers for admitting an operating, low-pressure fluid to said fluid admitting means of each of said intensifiers in turn, and repetitively.

Further objects of this invention, as well as the novel features thereof, will become more apparent by reference to the following description, taken in conjunction with the following figures in which:

FIG. 4 is a cross sectional view of the valve taken along section 4—4 of FIG. 3;

Figure 1:
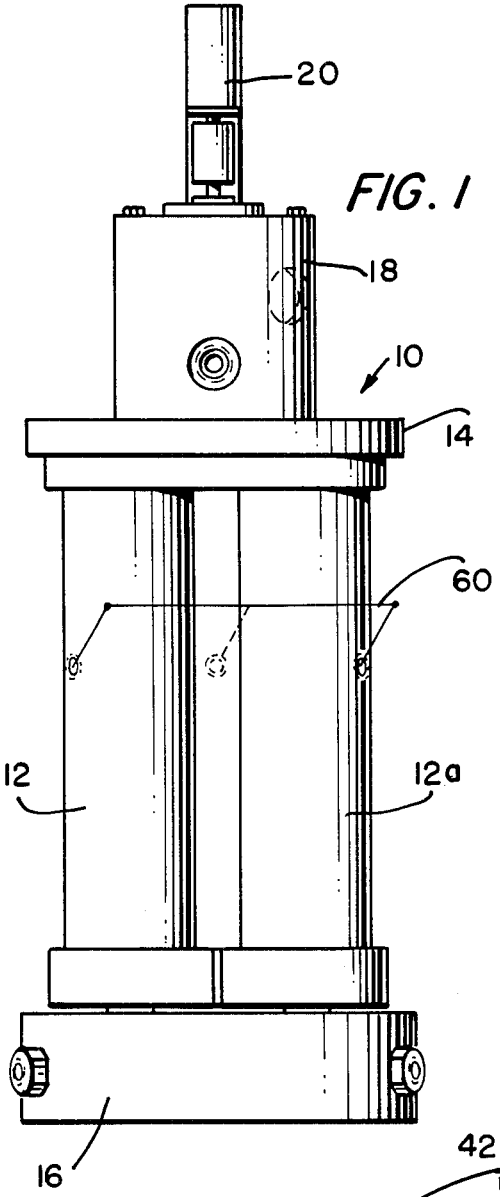
FIG. 1 is a side elevational view of an embodiment of the invention.
Figure 2:
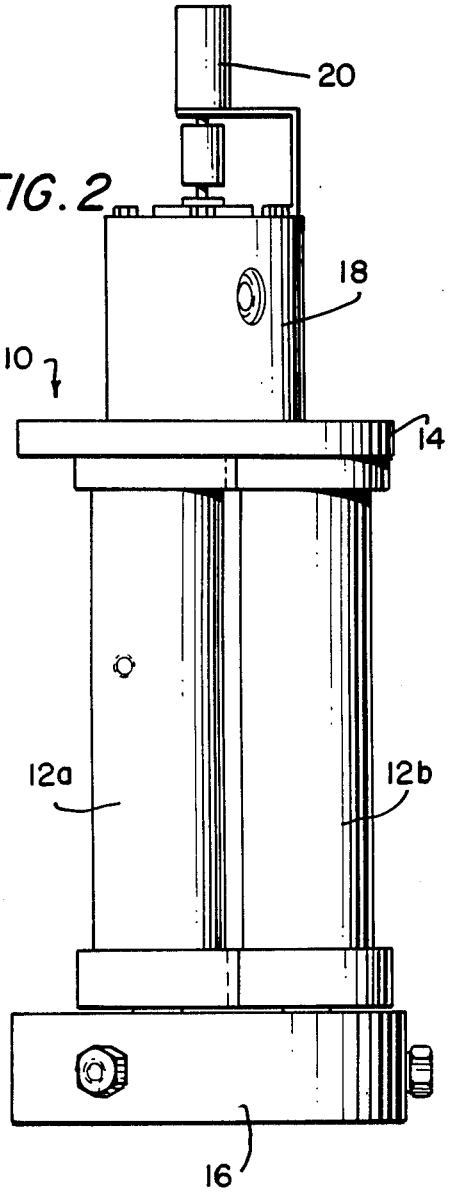
FIG. 2 is an elevational view of the embodiment of FIG. 1 taken from the right hand side of FIG. 1.
Figure 3:
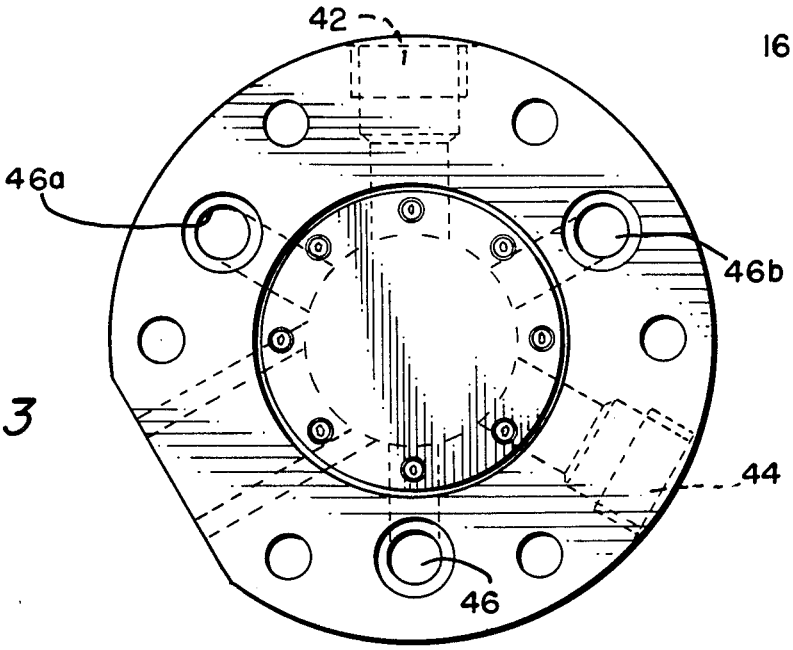
FIG. 3 is a view of an end of the rotary valve used to control and sequence the intensifier unit, the same showing that end thereof which is coupled to a support plate.

FIGS. 5, 6, and 7 are cross-sectional views taken from cross-sections 5—5, 6—6, and 7—7 respectively, in FIG. 4;

FIG. 8 is a cross-sectional view taken along the central axis thereof, of one of the intensifiers;

FIG. 9 is a plan view of the base plate which receives the discharge ends of the intensifiers;

FIG. 10 is a cross-sectional view taken along section 10—10 of FIG. 9; and FIGS. 11A through 11H are sequencing illustrations depicting the operation of the rotary valve with respect to the three intensifiers.

As shown in the figures, the novel intensifier unit 10 comprises three identical intensifiers 12, **12*a* and 12*b* coupled together in juxtaposition by means of a support plate 14 at one end, and a base plate 16 at the other. Fixed to the support plate 14 is a rotary valve 18 driven by a hydraulic motor 20 which rotates a valving rotor 22 within a valve housing 24. The rotor 22 has a pair of lands 26 and 28 spaced apart from each other, the lands extending radially on opposite sides of the rotary axis 30 of the rotor. Each of the lands 26 and 28 subtends an arc of approximately two hundred and twenty degrees. Ends 32 and 34 of the rotor are journaled in bearings 36 supported in the housing 24. Intermediate the lands 26 and 28, the rotor 22 has a shank portion 38 with radially extended, oppositely disposed lobes 40 and 40*a* which occupy arcs of approximately twenty degrees. Adjacent to one end of the valve housing 24 is a port 42 for admitting hydraulic fluid under pressure into the central bore of the housing, and a second port 44 adjacent to the opposite end of the valve housing is provided for discharging the aforesaid hydraulic fluid therethrough for return to a reservoir. Opening into the housing, and midway therealong, are three conduits 46, 46*a*, and 46*b* which further extend, through the housing, to one end thereof. The latter conduits are provided for admitting and discharging hydraulic fluid to and from the three intensifiers 12, 12*a* and 12*b*. During normal operation of the unit 10, hydraulic fluid is supplied constantly, under pressure, to the port 42 of the valve 18, and the discharge port 44 is always open to a reservoir (not shown). Accordingly, as the hydraulic motor 20 rotates the rotor 22 the hydraulic fluid under pressure is admitted to each of the intensifiers 12, 12*a* and 12*b* in turn. As FIGS. 4 through 7 evidence, the rotor 22, its lands 26 and 28, its shank portion 38, and the relative positions of ports 42 and 44 cooperate: (a) to apply the full supply of pressured hydraulic fluid to one of the intensifiers 12, 12*a* and 12*b*, or a shared supply thereof to two of the intensifiers, and (b) to connect two of the intensifiers to the reservoir (via port 44) or only one to the reservoir, respectively. The sequence illustrations FIGS. 11A through 11H show this. In FIG. 11A conduit 46 is supplied the pressured hydraulic fluid "P", from port 42, solely. Consequently, the piston 52 of the communicating intensifier is driven in a power stroke at a given acceleration. Conduits 46*a* and 46*b* are in shared communication with the reservoir (or tank "T"). The communicating other intensifiers, then, have their pistons 52 retracting at half said acceleration. With rotation of the rotor 22 to the FIG. 11B position, shank portion 38 disposes its lobe 40 in closure of conduit 46*a*; hence only conduit 46*b*, then, is left in communication with the reservoir. The piston 52 of the associated intensifier, therefore, will continue retracting—but now at the aforesaid given acceleration. By the time the shank portion 38 has come to the dispositions of FIGS. 11C and 11D, the conduits 46 and 46*a* are sharing the operating hydraulic fluid from port 42, and the pistons 52** of the communicating intensifiers move in power strokes at but half the aforesaid given acceleration.

Each intensifier, intensifier 12 as depicted in FIG. 8 being representative, has an open end 48 which is fastened to the support plate 14. In turn the support plate 14 has three channels 50 formed therethrough to communicate the conduits 46, 46*a* and 46*b* with the open ends 48 of the intensifiers. Each intensifier has a large, low-pressure piston 52 and a small, high-pressure piston or plunger 54 connected thereto, quite as is known in the prior art. The latter, of course, is used to intensify the pressure of the subject fluid. Intermediate the length of the intensifier is formed a port 56 which is provided for a hydraulic communication in common with the other two intensifiers (12*a*, 12*b*) in the unit 10. That is to say that beneath the low-pressure piston of each intensifier there is formed a return, variable-volume chamber 58 which is commonly manifolded with the other variable-volume chambers 58 of the other intensifiers, by a manifold 60 shown only schematically in FIG. 1. Therefore, when any given intensifier translates its low-pressure piston 52 toward its far, discharge end, it expels fluid from its variable-volume chamber 58 to the other intensifiers. As a consequence thereof, this causes a retraction of the pistons 52 in the other intensifiers. It is in this way that each intensifier piston 52 (and 54) is returned or retracted to its starting position by the forward or powered strokes of its companion, low-pressure pistons 52.

The manifold 60 and the variable-volume chambers 58 together define a given and fixed fluid capacity. The chambers 58 and manifold 60 are charged with hydraulic fluid so as to insure that, as a given piston 52 is displaced by the hydraulic fluid directed thereto via a channel 50 and port 42, such piston 52, in turn, expels hydraulic fluid via the corresponding intensifier's port 56, and the expelled fluid, via manifold 60, causes one or both of the other pistons 52 to retract. The expelled fluid enters the port(s) 56 of the one (or both) piston(s) as the rotary positioning of the shank portion 38 of the rotor 22 will allow.

FIGS. 9 and 10 disclose the novel base plate 16 to which each of the intensifiers 12, 12*a*, 12*b* is coupled through the lower discharge ends thereof. FIG. 10 shows only the discharge end of only one of the intensifiers engaged therewith. The plate 16 has three channels 62 formed therewithin, one hundred and twenty degrees apart, and all three converge and join in the center where there is an orifice 64 formed for the discharge of the intensified fluid. Ports 66 formed in threaded plugs 68 threaded into tapped holes in the outer periphery of the plate each open onto each one the channels and, therethrough, supply the liquid which is to be intensified. As a plunger 54 retracts, it draws liquid from the port 66 (from a supply not shown) into the intensifier. Then, as the plunger 54 is driven by its coupled low-pressure piston 52, the liquid has its pressure greatly amplified and it is forced through the channel 62 provided therefor to the central orifice 64 in the plate 16. Each intensifier in turn, then, discharges its high-pressure liquid through its respective channel 62 in the plate 16 to the central, common orifice 64. Check valves 70 and 72 prevent a reverse flow of liquid through port 66, and orifice 64, respectively.

While I have described my invention in connection with a specific embodiment thereof, it is to be clearly understood that this is done only by way of example and not as a limitation to the scope of my invention as set forth in the objects thereof and in the appended claims.

I claim:

1. A liquid intensifier unit, comprising:

a plurality of separately-housed and self-contained liquid intensifiers; and means fastening said intensifiers together in juxtaposition; wherein each of said intensifiers has a first, common means for both admitting thereinto, and discharging therefrom, respectively, an operating, low-pressure fluid;

each of said intensifiers further has a second, common means for both admitting thereinto, and discharging therefrom, respectively, a subject liquid for pressure intensification of such liquid by such each intensifier;

each of said intensifiers also has a given, variable volume chamber formed therewithin for receiving therewithin, and expelling therefrom, an operating liquid; and further, including third means effecting an open, fluid communication of each of said given, variable-volume chambers with each of the others thereof for conducting operating liquid, expelled from a given chamber of one of said intensifiers, to said given chamber of another of said intensifiers; and valving means, coupled to said intensifiers for admitting an operating, low-pressure fluid to said first, fluid admitting means of each of said intensifiers, in turn, and repetitively; wherein said valving means comprises a rotary valve;

said valve having a housing with a cylindrical bore formed therein; and a rotor-type valving element rotatably journaled, on an axis, in said bore; wherein said element has a pair of spaced-apart radial lands which sealingly engage the inner surface of said bore;

said lands extend circumferentially through approximately two hundred and twenty degrees of arc.

2. A liquid intensifier unit, according to claim 1, wherein:

said fastening means comprises a support plate;

said support plate has a given plurality of apertures formed therein for conducting fluid therethrough, said apertures of said plurality being the same in number as said intensifiers; and said fastening means further includes fastening hardware removably securing said intensifiers and said plate together, with each one of said apertures in fluid-flow communication with said first, fluid admitting and discharging means of one of said intensifiers.

3. A liquid intensifier unit, according to claim 1, further including:

means interposed in each of said channels for prohibiting a conduct of liquid from one of said ports of any pair thereof to the other of said ports of such pair.

4. A liquid intensifier unit, according to claim 1, wherein:

each of said intensifiers has a low-pressure piston therewithin movable in first and second, opposite, power-stroke and retraction-stroke directions, respectively;

and said first means, and said valving means, together comprise means for moving each low-pressure piston of each intensifier, in turn and repetitively, in said power-stroke direction, at a given velocity and at approximately double said given velocity.

5. A liquid intensifier unit, according to claim 4, wherein:

said moving means comprises means for moving said low-pressure pistons, as aforesaid, each time, internally at said given velocity, then at said approximately double velocity, and then at said given velocity again.

6. A liquid intensifier unit, according to claim 1, wherein:

said fastening means comprises a base plate;

said base plate has a given plurality of channels formed therein;

each of said channels has a pair of ports, formed in, and opening externally of, said plate, in communication therewith;

an orifice formed in said plate, and opening both externally and internally of said plate; and ends of each of said channels are in fluid-flow communication, with said orifice.

7. A liquid intensifier unit, according to claim 6, wherein:

said subject liquid admitting and discharging means, of each of said intensifiers, comprises means nestably engaged with one of said ports of one of said pairs thereof.

8. A liquid intensifier unit, according to claim 1, wherein:

said lands occupy given planes, normal to said axis, intermediate the axial ends of said bore;

said housing has a first port formed therein which opens onto said bore, intermediate one of said lands and an axial end of said bore most adjacent to said one land;

said housing has a second port formed therein which opens onto said bore, intermediate the other of said lands and the other axial end of said bore;

one of said first and second ports comprises means for admitting low-pressure fluid into said bore, and the other of said first and second ports comprises means for discharging such admitted fluid from said bore;

and said housing has a plurality of conduits, formed therein, each thereof opening, at one end, internally onto said bore, intermediate said lands, and, at the opposite end thereof, externally of said housing.

9. A liquid intensifier unit, according to claim 8, wherein:

said valving element has a shank portion; intermediate said lands;

said shank portion has a pair of lobes extending radially therefrom on opposite sides of said axis;

said lobes sealingly engage the inner surface of said bore; and said lobes comprise means for cyclically occluding and opening said ports.

10. A liquid intensifier unit, according to claim 9, wherein:

said lobes bridge between, and axially join, said radial lands.

11. A liquid intensifier unit, according to claim 1, wherein:

said third means comprises a manifold; and said variable-volume chambers and said manifold together define a common, fixed-volume reservoir.

12. A liquid intensifier unit, according to claim 11, wherein:

each of said intensifiers has a low-pressure piston therewithin movable in first and second, opposite directions; and said valving means and said reservoir comprise means cooperative for moving at least one of said low-pressure pistons, in one of said intensifiers, in one of said first and second directions, in response to a movement of at least one other low-pressure piston, in another of said intensifiers, in the other of said first and second directions.

13. A liquid intensifier unit, according to claim 11, wherein:

each of said intensifiers has a low-pressure piston therewithin movable in first and second, opposite directions; and said valving means and said reservoir comprise means cooperative for moving at least one of said low-pressure pistons, in one of said intensifiers, in one of said first and second directions, at a given velocity, in response to movement of at least two other low-pressure pistons, and second directions, at approximately half of said given velocity.

14. A liquid intensifier unit, according to claim 11, wherein:

each of said intensifiers has a low-pressure piston therewithin movable in first and second, opposite directions; and said valving means and said reservoir comprise means cooperative for moving at least two of said low-pressure pistons, in two of said intensifiers, in one of said first and second directions, at a given velocity, in response to movement of one other low-pressure piston, in another of said intensifiers, in the other of said first and second directions, at approximately half said given velocity.

* * * * *